US010941367B2

(12) United States Patent
Dietl et al.

(10) Patent No.: US 10,941,367 B2
(45) Date of Patent: Mar. 9, 2021

(54) FUNCTIONAL FLUID COMPOSITION

(71) Applicant: BASF SE, Ludwigshafen (DE)

(72) Inventors: Harald Dietl, Ludwigshafen (DE); Bayram Aydin, Ludwigshafen (DE); Stefan Dambach, Forst (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 15/027,386

(22) PCT Filed: Oct. 8, 2014

(86) PCT No.: PCT/EP2014/071539

§ 371 (c)(1),
(2) Date: Apr. 5, 2016

(87) PCT Pub. No.: WO2015/052234

PCT Pub. Date: Apr. 16, 2015

(65) Prior Publication Data

US 2016/0237366 A1 Aug. 18, 2016

(30) Foreign Application Priority Data

Oct. 10, 2013 (EP) ..... 13188078

(51) Int. Cl.

| | |
|---|---|
| ***C07F 5/04*** | (2006.01) |
| ***C09K 5/00*** | (2006.01) |
| ***C10M 105/78*** | (2006.01) |
| ***C10M 169/04*** | (2006.01) |
| ***C10M 129/08*** | (2006.01) |
| ***C10M 129/16*** | (2006.01) |
| ***C10M 133/06*** | (2006.01) |
| ***C10M 133/08*** | (2006.01) |
| ***C10M 133/44*** | (2006.01) |
| *C10N 20/00* | (2006.01) |
| *C10N 30/02* | (2006.01) |
| *C10N 30/06* | (2006.01) |
| *C10N 30/12* | (2006.01) |
| *C10N 40/08* | (2006.01) |

(52) U.S. Cl.

CPC ..... *C10M 105/78* (2013.01); *C10M 129/08* (2013.01); *C10M 129/16* (2013.01); *C10M 133/06* (2013.01); *C10M 133/08* (2013.01); *C10M 133/44* (2013.01); *C10M 169/04* (2013.01); *C10M 169/041* (2013.01); *C10M 2207/022* (2013.01); *C10M 2207/04* (2013.01); *C10M 2207/046* (2013.01); *C10M 2207/128* (2013.01); *C10M 2209/104* (2013.01); *C10M 2209/108* (2013.01); *C10M 2209/1045* (2013.01); *C10M 2215/042* (2013.01); *C10M 2215/223* (2013.01); *C10M 2215/30* (2013.01); *C10M 2227/00* (2013.01); *C10M 2227/0615* (2013.01); *C10N 2020/015* (2020.05); *C10N 2030/02* (2013.01); *C10N 2030/06* (2013.01); *C10N 2030/12* (2013.01); *C10N 2040/08* (2013.01)

(58) Field of Classification Search

CPC ..... C10M 107/52; C10M 107/32; C10M 105/78; C10M 169/041; C10M 129/08; C10M 129/16; C10M 133/06; C10M 133/08; C10M 133/44; C10M 169/04; C10M 2209/108; C10M 2227/0615; C10M 2207/128; C10M 2207/046; C10M 2209/1045; C10M 2209/104; C10M 2207/022; C10M 2207/04; C10M 2215/30; C10M 2227/00; C10M 2215/042; C10M 2215/223; C10N 2020/015; C10N 2030/02; C10N 2030/06; C10N 2030/12; C10N 2040/08

USPC ..... 508/199; 252/77

See application file for complete search history.

(56) References Cited

U.S. PATENT DOCUMENTS

| | | | | |
|---|---|---|---|---|
| 4,371,448 A | | 2/1983 | Knoblauch et al. | |
| 5,360,560 A | * | 11/1994 | Schmid | B01D 19/0404 252/76 |
| 6,558,569 B1 | * | 5/2003 | Shannon | C10M 111/04 252/71 |
| 2005/0256014 A1 | * | 11/2005 | Sherman | C08G 65/2609 508/579 |

(Continued)

FOREIGN PATENT DOCUMENTS

| | | |
|---|---|---|
| DE | 696 07 247 T2 | 9/2000 |
| EP | 0 750 033 A1 | 12/1996 |

(Continued)

OTHER PUBLICATIONS

International Search Report dated Jan. 30, 2015 in PCT/EP2014/071539.

(Continued)

*Primary Examiner* — Prem C Singh
*Assistant Examiner* — Francis C Campanell
(74) *Attorney, Agent, or Firm* — Grüneberg and Myers PLLC

(57) ABSTRACT

A functional fluid composition useful as a brake fluid comprising from 0 to 94.99% by weight of alkoxy glycols of borate esters, from 5 to 99.99% by weight of alkoxy glycols, from 0.01 to 5% by weight of alkoxylates of saturated or unsaturated hydroxy-substituted fatty acids such as ricinoleic acid or esters thereof, the hydroxyl group located on the fatty acid side chain being etherified by at least one oxyalkylene unit, and from 0 to 10% by weight of an additive package comprising additives with corrosion inhibition action.

11 Claims, No Drawings

(56) References Cited

U.S. PATENT DOCUMENTS

2012/0245066 A1* 9/2012 Larem ..... C10M 145/36
508/452

FOREIGN PATENT DOCUMENTS

| | | | |
|---|---|---|---|
| GB | 908291 | | 10/1962 |
| WO | WO 00/65001 | A1 | 11/2000 |
| WO | WO 02/38711 | A1 | 5/2002 |
| WO | WO 2008/123323 | A1 | 10/2008 |
| WO | WO 2013/171052 | A1 | 11/2013 |

OTHER PUBLICATIONS

International Preliminary Report on Patentability dated Feb. 3, 2016 in PCT/EP2014/071539.
Written Opinion dated Feb. 3, 2016 in PCT/EP2014/071539.
U.S. Appl. No. 13/891,591, filed May 10, 2013, US 2013-0310286 A1, Harald Dietl, et al.

* cited by examiner

FUNCTIONAL FLUID COMPOSITION

The present invention relates to a functional fluid composition comprising:

(A) from 0 to 94.99% by weight, based on the weight of the total composition, of one or more alkoxy glycol borate esters having the general formula (I)

$$[R^1—O—(CH_2CH_2—O)_n]_3B \quad (I)$$

wherein $R^1$ is a $C_1$- to $C_8$-alkyl radical or a mixture of such radicals and n has a value of from 2 to 6;

(B) from 5 to 99.99% by weight, based on the weight of the total composition, of one or more alkoxy glycol components having the general formula (II)

$$R^2—O—(CH_2CH_2—O)_m—H \quad (II)$$

wherein $R^2$ is a $C_1$- to $C_8$-alkyl radical or a mixture of such radicals and m has a value of from 2 to 6, $R^2$ and/or m being different or identical to $R^1$ and/or n, respectively;

(C) from 0.01 to 5% by weight, based on the total weight of the composition, of an alkoxylate of a saturated or unsaturated hydroxy-substituted $C_8$ to $C_{22}$ fatty acid or of an ester thereof, the hydroxyl group located on the fatty acid side chain of said alkoxylate being etherified by at least one oxyalkylene unit;

(D) from 0 to 10% by weight, based on the total weight of the composition, of an additive package comprising one or more additives with corrosion inhibition action.

The said functional fluid composition is useful in a variety of applications and in parti-cular as a brake fluid. It provides for excellent lubricating action with moving parts within technical devices filled with such functional or hydraulic fluids, e.g. the brake systems of vehicles with hydraulic brake systems such as passenger cars and small trucks.

In modern vehicle brake systems, braking control is regulated by hydraulic units which contain pumps with a running time much longer than in conventional vehicle brake systems. A typical running time of such pump in such a hydraulic unit is about 1,000 hours, in contrast to about 10 hours pump running time in vehicle brake systems with conventional ABS hydraulic units. Pumps in hydraulic units comprise sealing parts made of rubber or elastomeric material which normally suffers from wear. Therefore, modern functional fluids must exhibit excellent lubricating action and reduce friction, ensuring that no or only a very low degree of wear of the parts of the hydraulic unit occurs. Especially, they must protect the rubber or elastomeric material of sealing parts from becoming deformed and leaking, thus causing misoperation and lack of safety for running the vehicle.

Furthermore, in a specific embodiment, the said functional fluid composition exhibits low viscosity and, therefore, is useful for new electronic or automated anti-lock brake systems which require lower viscosity fluids for satisfactory operation at low tempera-tures.

Functional fluid compositions based on borate esters are well known in the art. To be useful for example as DOT 4 or DOT 5.1 brake fluids, these borate ester based compositions must meet stringent physical properties and performance requirements particularly with respect to minimum dry equilibrium reflux boiling point ("ERBP"), minimum wet equilibrium reflux boiling point ("WERBP") and maximum low temperature kinematic viscosity (e.g. determined at −40° C.) while maintaining adequate resistance to corrosion, stability and meeting other physical property requirements such as pH, reserve alkalinity and rubber swell.

Furthermore, functional fluid compositions without any borate esters are known in the art and useful for example as DOT 3 brake fluids.

WO 2013/171052 describes hydraulic fluids comprising alkoxy glycol borate esters, alkoxy glycols and corrosions inhibitors, further containing an alkyl amine ethoxylate.

WO 00/65001 describes hydraulic fluids comprising alkoxy glycol borate esters, alkoxy glycols and corrosions inhibitors, further containing cyclic carboxylic acid derivatives.

WO 02/38711 describes low viscosity functional fluid compositions comprising alkoxy glycol borate esters, alkoxy glycol components and additives such as corrosion inhibitors, wherein the alkoxylation degrees of the alkoxy glycol borate esters and the alkoxy glycols are restricted to a certain narrow pattern.

DE 696 07 247 T2 describes hydraulic fluids comprising a mixture of ethoxylated mono-, di- or polyamines or fatty amines and reaction products of carboxylic fatty acids or esters thereof with polyoxyalkylene glycols such as the interesterification product from castor oil and dipropylene glycol. Said mixture functions as corrosion inhibiting system.

British Patent Specification 908,291 describes hydraulic fluids comprising purified ricinoleic esters obtained by interesterification of castor oil and polyalkylene glycols, such as ethylene glycol, and subsequent purification by passing over ion exchange resins and subjecting the purified esters to hot blowing by means of gas containing free oxygen. The said ricinoleic esters exhibit lubricating properties in hydraulic fluids.

There is a strong demand for improved high performance hydraulic fluid compositions and brake fluids providing excellent lubricity action, i.e. reducing friction. Moreover, there is a strong demand for high performance hydraulic fluid compositions and brake fluids providing excellent lubricity action and having low temperature viscosity while meeting or exceeding at the same time the minimum ERBP and especially the WERBP temperature requirements as fulfilled by the hydraulic fluid compositions and brake fluids described in the art.

According to the present invention, the above-defined functional fluid composition has been found which exhibits excellent lubricity action and superior values of ERBP and of WERBP and for low temperature kinematic viscosity while maintaining excellent resistance to corrosion, high stability and meeting other physical property requirements such as pH and reserve alkalinity. Moreover, kinematic viscosity value at very low temperatures below −40° C., e.g. at −50° C., are superior compared to functional fluid compositions of the art.

In a preferred embodiment, the alkoxylate of component (C) is an alkoxylate of ricinoleic acid, of castor oil or of any other ricinoleic acid ester, preferably of ricinoleic acid or castor oil and very preferably of castor oil.

This castor oil for the purposes of the present specification is an at least partly and preferably wholly esterified acyl glycerol wherein at least one, preferably at least two, of the acyl groups are ricinoleic acid or isoricinoleic acid, preferably ricinoleic acid.

For example, the mixture of fatty acids preferably comprises a mixture of two molecules of ricinoleic acid with a fatty acid which carries no hydroxyl group, preferably selected from the group consisting of oleic acid, linoleic acid, palmitic acid, and stearic acid.

In one preferred embodiment the castor oil has an OH number of 160 to 173 mg KOH/g.

The alkoxylate of component (C), especially the alkoxylate of ricinoleic acid, of castor oil or of any other ricinoleic acid ester, is preferably prepared by reaction of a saturated or unsaturated hydroxy-substituted $C_8$ to $C_{22}$ fatty acid or of an ester thereof, especially by reaction of ricinoleic acid, of castor oil or of any other ricinoleic acid ester, with at least one alkylene oxide. The alkylene oxide may be propylene oxide, butylene oxide, styrene oxide or preferably ethylene oxide. Mixtures of such alkylene oxides resulting in statistic or block structures of alkylene oxide units may also be used.

In detail, the structure of said alkoxylate of component (C) preferably comprises a saturated or unsaturated $C_8$ to $C_{22}$ fatty monocarboxylic acid or at least one saturated or unsaturated $C_8$ to $C_{22}$ fatty monocarboxylic acid unit in the molecule, being esterified with one or more oxyalkylene units at the free carboxylic acid function if such free carboxylic acid function is present in the molecule and carrying a hydroxyl group located on the fatty acid side chain of said alkoxylate being etherified by one or more oxyalkylene units.

Examples of such saturated or unsaturated hydroxyl-substituted $C_8$ to $C_{22}$ fatty mono-carboxylic acids or units thereof, preferably of saturated or unsaturated hydroxyl-substituted $C_{14}$ to $C_{20}$ fatty mono-carboxylic acids or units thereof, as the basis for the alkoxylates of component (C), are 10-hydroxy stearic acid, 12-hydroxystearic acid and especially ricinoleic acid. Such unsaturated hydroxyl-substituated $C_8$ to $C_{22}$ fatty mono-carboxylic acids may be taken as free carboxylic acids or as corresponding esters for preparing the alkoxylate of component (C). In case of ricinoleic acid, castor oils as its naturally occurring triglyceride may advantageously be reacted, as an interesterification, with an alkylene oxide resulting in the desired ricinoleic alkoxylate and glycerol. Any other ester of ricinoleic acid, e.g. the corresponding di- or monoglyceride or the corresponding methyl, ethyl, propyl or butyl ester, may be used as educt for interesterifi-cation. Depending on the conditions of the alkoxylation reaction with esters of ricinoleic acid, especially with castor oils, the ester and especially the triglyceride may also keep its carboxylic ester function, especially its glycerol triester function, and solely be alkoxylated at the hydroxyl group located on the fatty acid side chain, being etherified there by one or more oxyalkylene units.

The said alkoxylate of component (C), especially the alkoxylate of ricinoleic acid, of castor oil or of any other ricinoleic acid ester, usually comprises from 2 to 200, preferably from 4 to 100, more preferably from 6 to 80, most preferably from 10 to 50, and especially 20 to 40 alkylene oxide units which are preferably ethylene oxide units. "Number of alkylene oxide units" means mols of alkylene oxide per mole of the saturated or unsaturated hydroxyl-substituated $C_8$ to $C_{22}$ fatty mono-carboxylic acid or of the units thereof, as the basis for the alkoxylate of component (C). Using castor oil which is the triglyceride of ricinoleic acid, the amount of alkylene oxide used for alkoxylation refers to 3 equivalents of ricinoleic acid or units thereof to be alkoxylated. For higher alkoxylation degrees, the number of alkylene units is a mean value as a statistical number, due to a distribution of alkoxylation homologues in the product. There may be two types of hydroxyl groups in the molecule to be alkoxylated, i.e. one to be esterified (or inter-esterified) and the other to be etherified, esterification may occur or may not occur, etherification will always occur.

Methods of alkoxylation, especially ethoxylation, of carboxylic acids or esters thereof, such as castor oil, are known in the art and, therefore, do not need to be further described in this application.

Component (A) of the functional fluid composition of general formula (I) comprises species of ethoxylation degree of from n=2 to n=6, preferably of from n=2 to n=4, more preferably of n=3 to n=4, and very preferably n=3. Component (A) may be a single species or a mixture of different species with regard to the ethoxylation degree and/or to radical $R^1$. Radical $R^1$ is preferably a $C_1$- to $C_4$-alkyl radical and may be methyl, ethyl, n-propyl, isopropyl, n-butyl, isobutyl, sec-butyl, tert-butyl, n-pentyl, n-hexyl, n-heptyl, n-octyl and 2-ethylhexyl, ethyl, very preferably n-butyl or methyl, and especially methyl being preferred.

The said borate esters and their methods of preparation are well known in the art. Borate esters especially useful in the functional fluid composition of the present invention may be prepared by reacting boric acid with suitable alkoxy glycol components which are different or identical to those of component (B), preferably identical to component (B). Typically, such alkoxy glycol components are mixtures of different species with regard to the ethoxylation degree and/or to radical $R^1$, especially with regard to the average ethoxylation degree, which results in a certain standard deviation of the degree of ethoxylation, i.e. the numbers n or m.

Examples of useful borate esters include those containing methyl triethylene glycol borate ester which can also be named tris-[2-[2-(2-methoxyethoxy)-ethoxy]-ethyl) orthoborate, ethyl triethylene glycol borate ester, n-butyl triethylene glycol borate ester and mixtures thereof. Further useful borate esters include those containing methyl tetraethylene glycol borate ester, methyl diethylene glycol borate ester, ethyl tetra-ethylene glycol borate ester, ethyl diethylene glycol borate ester, n-butyl tetraethylene glycol borate ester, n-butyl diethylene glycol borate ester and mixtures thereof.

In a preferred embodiment, component (A) comprises at least on alkoxy glycol borate ester of general formula (I) wherein the ethoxylation degree has a value of n=3 and $R^1$ is a methyl radical.

Component (B) of the functional fluid composition of general formula (II) comprises species of ethoxylation degree of from m=2 to m=6, preferably of from m=2 to m=4, more preferably of m=3 to m=4, and very preferably m=3. Component (B) may be a single species or a mixture of different species with regard to the ethoxylation degree and/or to radical $R^2$. Radical $R^2$ is preferably a $C_1$- to $C_4$-alkyl radical and may be methyl, ethyl, n-propyl, isopropyl, n-butyl, isobutyl, sec-butyl, tert-butyl, n-pentyl, n-hexyl, n-heptyl, n-octyl and 2-ethylhexyl, ethyl, very preferably n-butyl or methyl, and especially methyl being preferred.

Examples of useful alkoxy glycols for component (B) of the present invention include methyldiglycol, methyltriglycol, methyltetraglycol, methylpentaglycol, methylhexaglycol, ethyldiglycol, ethyltriglycol, ethyltetraglycol, ethylpentaglycol, ethylhexaglycol, n-propyl-diglycol, n-propyltriglycol, n-propyltetraglycol, n-propylpentaglycol, n-propylhexaglycol, n-butyldiglycol, n-butyltriglycol, n-butyltetraglycol, n-butylpentaglycol, n-butylhexaglycol, n-pentyldiglycol, n-pentyltriglycol, n-pentyltetraglycol, n-pentylpentaglycol, n-pentyl-hexaglycol, n-hexyldiglycol, n-hexyltriglycol, n-hexyltetraglycol, n-hexylpentaglycol, n-hexylhexaglycol, 2-ethylhexyldiglycol, 2-ethylhexyltriglycol, 2-ethylhexyltetraglycol, 2-ethylhexylpentaglycol, 2-ethylhexylhexaglycol and mixtures thereof. For the avoidance of doubt, "glycol" always means "ethylene glycol".

In a preferred embodiment, component (B) comprises a mixture of alkoxy glycols of general formula (II) comprising solely or predominantly species with m=3 and/or 4. Predominantly shall mean that at least 60% by weight, more preferably at least 75% by weight, most preferably at least 90% by weight, of component (B) comprises species with m=3 and/or 4. In the last case, alkoxy glycol species with m lower than 3, e.g. with m=2, and/or with m higher than 4, e.g. with m=5 and/or m=6, may be present in minor amounts, preferably less than 10% by weight, more preferably less than 8% by weight and even more preferably less than 5% by weight.

An especially preferred mixture of such alkoxy glycols for component (B) with m=3 is a mixture consisting solely or essentially of methyltriglycol and n-butyltriglycol. Typically, the weight ratio of methyltriglycol to n-butyltriglycol in this mixture is from 5:1 to 1:2, especially from 2:1 to 1:1.

Component (D) which may be present in the functional fluid composition is an additive package comprising one or more additives with corrosion inhibiting action. Preferably, the at least one additive with corrosion inhibiting action is selected from alkylamine ethoxylates.

The alkylamine residue in the said alkylamine ethoxylates may be a secondary or preferably a primary aliphatic monoamine which is capable of being ethoxylated. Usually secondary or preferably primary aliphatic monoamines are used, however, polyamines with at least one secondary and/or primary amino group which is capable of being ethoxylated may also be used. The alkyl residues to the nitrogen atom normally comprise saturated linear or branched alkyl groups, however, unsaturated linear or branched alkyl residues or saturated or unsaturated cycloalkyl residues may also be comprised by the term "alkyl".

In a preferred embodiment, the said alkylamine ethoxylates comprise at least one linear or branched $C_3$ to $C_{20}$ alkyl chain, preferably at least one linear or branched $C_6$ to $C_{13}$ alkyl chain, more preferably at least one linear or branched $C_7$ to $C_{12}$ alkyl chain, most preferably at least one linear or branched $C_8$ to $C_{11}$ alkyl chain, especially preferably a linear $C_8$ alkyl chain. Preferably, the term "alkyl chain" here means saturated and non-cyclic hydrocarbon residues. The alkylamine ethoxylates may also comprise mixtures of such alkyl chains, for example a mixture of homologue alkyl residues, depending on the specific technical or natural origin of the alkylamines used.

Suitable examples for single alkylamine molecules being capable for ethoxylation, and also suitable as surfactants for the instant, invention are n-propylamine, isopropyl-amine, n-butylamine, isobutylamine, sec-butylamine, tert-butylamine, n-pentylamine, tert-pentylamine, n-hexylamine, n-heptylamine, n-octylamine, 2-ethylhexylamine, n-nonylamine, n-decylamine, 2-propylheptylamine, n-undecylamine, n-dodecylamine, n-tridecylamine, isotridecylamine, n-tetradecylamine, n-pentadecylamine, n-hexadecyl-amine, n-heptadecylamine, n-octadecylamine, n-nonadecylamine, n-eicosyl-amine, di-(n-hexyl)amine, di-(n-heptyl)amine, di(n-octyl)amine, di-(2-ethylhexyl)amine, di-(n-nonyl) amine, di-(n-decyl)amine, di-(2-propylheptyl)amine, di-(n-undecyl)amine, di-(n-dodecyl)amine, di-(n-tridecyl)amine, di(isotridecyl)amine, di-(n-tetradecyl)amine, di-(n-pentadecyl)amine, di-(n-hexadecyl)amine, di-(n-heptadecyl) amine, di-(n-octadecyl)-amine, di-(n-nonadecyl)amine, di-(n-eicosyl)amine, n-hexylmethylamine, n-heptylmethylamine, n-octylmethylamine, (2-ethylhexyl) methylamine, n-nonylmethylamine, n-decylmethylamine, (2-propylheptyl)methylamine, n-undecylmethylamine, n-dodecyl-methylamine, n-tridecylmethylamine, isotridecylmethylamine, n-tetradecylmethylamine, n-pentadecylmethylamine, n-hexadecylmethylamine, n-heptadecylmethylamine, n-octa-decylmethylamine, n-nonadecylmethylamine and n-eicosylmethylamine.

Such alkyl residues may be derived entirely from petrochemical production, for example technical $C_8$-$C_{15}$ alkyl mixtures, 2-ethylhexyl or 2-propylheptyl, or may entirely or partially be based on renewable raw materials, for example fatty amines such as stearyl amine, oleyl amine or tallow amine may be used as the basis for the alkylamine ethoxylates.

The degree of ethoxylation is usually from 1 to 35 ethylene oxide ("EO") units per alkylamine molecule, i.e. the at least on alkylamine ethoxylate comprises from 1 to 35 EO units, preferably from 1.5 to 15 EO units, more preferable from 1.8 to 9 EO units, most preferably from 2 to 6 EO units. The said ethoxylation degree is a statistical value, i.e the alkylamine ethoxylates have normally to be regardes as mixtures of species (homologues) with different numbers of EO units.

In an especially preferred embodiment of the instant invention, the at least one alkylamine ethoxylate comprises at least on linear $C_3$ to $C_{20}$ alkyl chain and from 1 to 35 EO units; more preferably the at least one alkylamine ethoxylate comprises at least on linear $C_6$ to $C_{13}$ alkyl chain and from 1.5 to 15 EO units; most preferably the at least one alkylamine ethoxylate comprises at least one linear $C_7$ to $C_{12}$ alkyl chain and from 1.8 to 9 EO units, especially the at least one alkylamine ethoxylate comprises at least one linear $C_8$ to $C_{11}$ alkyl chain and from 2 to 6 EO units.

Such alkylamine ethoxylates may be primary amines with one oxyethylene chain of general formula Alkyl-NH—$(CH_2CH_2O)_m$—H or primary amines with two oxyethylene chains of general formula Alkyl-N[$(CH_2CH_2O)_p$—H][$(CH_2CH_2O)_q$—H] or secondary amines of general formula $(Alkyl)_2N$—$(CH_2CH_2O)_m$—H or mixtures of such primary amines with one oxyethylene chain and such primary amines with two oxyethylene chains or mixtures of such primary and secondary amines, wherein m and (p+q), respectively, are the total ethoxylation degrees. "Alkyl" in the above formulas normally means $C_3$ to $C_{20}$ alkyl, preferably $C_8$ to $C_{13}$ alkyl, more preferably $C_7$ to $C_{12}$ alkyl, most preferably $C_8$ to $C_{11}$ alkyl, as defined above. Residual alkylamine species may also be present in lower amounts, especially with low total ethoxylation degrees below 2.

A typical suitable alkylamine ethoxylate is octylamine (caprylamine) with 2 EO units which is commercially available.

The said alkylamine ethoxylates can be prepared by usual methods such as the reaction of the alkylamine with ethylene oxide under catalysis by alkali metal hydroxides or under catalysis by double metal cyanides, as known to the skilled person in the art.

The said alkylamine ethoxylates has partly corrosion inhibition properties and partly solvent properties for the functional fluid composition or brake fluid, respectively, according to the present invention.

Component (D) of the present functional fluid composition may comprise, besides the alkylamine ethoxylates, at least one further additive with corrosion inhibition action. Suitable customary additives with corrosion inhibition properties include fatty acids such as lauric, palmitic, stearic or oleic acid; esters of phosphorus or phosphoric acid with aliphatic alcohols; phosphites such as ethyl phosphate, dimethyl phosphate, isopropyl phosphate, n-butyl phosphate, triphenyl phosphite and diisopropyl phosphite; reaction products of phosphorus pentoxide with alkoxy glycols as described as component (B) above, heterocyclic nitrogen containing organic compounds such as benzotriazole, tolutriazole, 1,2,4-triazole, benzoimidazole, purine, adenine and derivatives of such heterocyclic organic compounds; alkylamines such as mono- and di-($C_4$- to $C_{20}$-alkyl)amines, e.g. n-butyl-amine, n-hexylamine, n-octylamine, 2-ethyl-hexylamine, isononylamine, n-decylamine, n-dodecylamine, oleylamine, di-n-propyl-amine, di-isopropylamine, di-nibutylamine, di-n-amylamine, cyclohexylamine and salts of such alkylamines; alkanolamines such as mono-, di- and trimethanolamine, mono-, di- and triethanolamine, mono-, di- and tri-n-propanolamine and mono-, di- and tri-isopropanolamine. Of course, mixtures of the above additives with corrosion inhibition action can be used.

Besides the alkylamine ethoxylates and possibly the additives with corrosion inhibition action, further customary additives may be present in the additive package of component (D), for example stabilizers such as pH stabilizers, antioxidants such as phenol-thiazine and phenolic compounds, e.g. hydroxyanisol and bisphenol A, defoamers and dyes.

Preferably, the additive package of component (D) which includes one or more alkyl-amine ethoxylates consists or consists essentially of a major portion of additives with corrosion inhibition action and a minor portion of additives with antioxidant action and possibly of defoamers and dyes. The portion of alkylamine ethoxylate(s) in the additive package of component (D) is from 0 to 100% by weight, preferably of from 1 to 99% by weight, more preferably of from 10 to 98% by weight, most preferably of from 40 to 97% by weight, each based on the weight of the additive package of component (D).

It is contemplated that also other materials than components (A), (B), (C) and (D) may be formulated into the present functional fluid composition so long as care is taken not to lower the ERBP or WERBP temperatures below the superior high levels of the instant invention or to increase the low temperature viscosity above an acceptable level. For example, the present functional fluid composition may include from 0 to 20% by weight, based on the total weight of the composition, of a diluent or a lubricant such as, for example, polyethylene oxides, polypropylene oxides, poly ($C_4$- to $C_{10}$-alkylene) oxides, dialkoxyglycols or borate co-esters. Moreover, due to manufacturing processes, precursors of components (A) and/or (B), such as diethylene glycol and triethylene glycol, may also be present in the present functional fluid composition in small amounts, e.g. up to 5% by weight, especially up to 1.5% by weight, based on the total weight of the composition. Such precursors do not interfere with the action of compo-nents (C) or (D).

According to the present invention, the three components (A), (B), (C) and (D) are present in the functional fluid composition in the following amounts:

(A) from 0 to 94.99% by weight, preferably from 15 to 90% by weight, more preferably from 30 to 75% by weight, still more preferably from 45 to 65% by weight, most preferably from 56 to 62% by weight;

(B) from 5 to 99.99% by weight, preferably from 5 to 80% by weight, more preferably from 20 to 65% by weight, still more preferably from 32 to 52% by weight, most preferably from 36 to 42% by weight;

(C) from 0.01 to 5% by weight, preferably from 0.05 to 2% by weight, more preferably from 0.1 to 1% by weight, most preferably from 0.15 to 0.9% by weight;

(D) from 0 to 10% by weight, preferably from 0.01 to 7% by weight, more preferably from 0.1 to 4% by weight, most preferably from 1.5 to 2.5% by weight.

All % values for (A), (B), (C) and (D) above refer to the total composition of the present functional fluid composition, or—if other materials than components (A), (B), (C) and (D), e.g. the above-mentioned diluents and/or lubricants, are present—to the total weight of (A) plus (B) plus (C) plus (D). The % values for (A), (B), (C) and (D) add up in each case to 100% by weight.

The functional fluid composition of the present invention exhibits superior behavior in ERBP and WERBP temperature and simultaneously in low temperature viscosity performance. Preferably, it exhibits an ERBP of at least 260° C., more preferably of at least 265° C., most preferably of at least 270° C., and/or a WERBP of at least 180° C., more preferably of at least 182° C., still more preferably of at least 184° C., most preferably of at least 185° C. and especially preferably of at least 187° C.

The functional fluid composition of the present invention exhibits a low temperature kinematic viscosity of preferably less than 750 centistokes ("cSt") (=$mm^2/s$), more preferably of less than 685 cSt, most preferably less than 680 cSt, each determined at a temperature of −40° C.

Subject of the present invention is also the use of an alkoxylate of a saturated or unsaturated hydroxy-substituted $C_8$ to $C_{22}$ fatty acid or of an ester thereof, the hydroxyl group located on the fatty acid side chain of said alkoxylate being etherified by at least one oxyalkylene unit, preferably by at least one oxyethylene unit, as an additive with lubricating action in functional fluids, especially in hydraulic fluids and brake fluids.

The functional fluid composition of the present invention is especially useful as a brake fluid, for example for vehicles with hydraulic brake systems such as passenger cars and small trucks, exhibiting excellent lubrication action and protecting the rubber or elastomeric material of sealing parts of pumps of the brake system from becoming deformed and/or leaking. Furthermore, the functional fluid composition of the present invention is useful for new electronic or automated anti-lock brake systems which require lower viscosity fluids for satisfactory operation at low temperatures.

Besides its superior behavior in ERBP and WERBP temperature and its low tempera-ture viscosity performance, the functional fluid composition of the present invention exhibits a good corrosion protection, a good water compatibility, a mild pH value, e.g. from approximately 7 to approximately 8.5, a good stability with regard to low and high temperatures, a good oxidation stability and a good chemical stability.

The following examples are intended to demonstrate the behavior and performance of the low temperature functional fluid composition of the present invention without limiting it.

EXAMPLES

The friction coefficient values of the following function fluid compositions containing a castor oil ethoxylate according to the present invention ("FFC1", "FFC2" and "FFC4") were determined according to the test procedures of DIN 51834-2, using elastomeric material test plates EPDM RM-69. For comparison, the friction coefficient value of a corresponding functional fluid composition without such castor oil ethoxylate ("FFC3") was determined and is confronted to FFC1 and FFC2. The lower the friction coefficient value the better the lubricity properties of the functional fluid composition.

Example 1

Measurements at 60° C., weight 300 g, ball diameter of 6 mm, 50 Hz, way length 1000 μm Compositions of FFC1, FFC2 and FFC3 (comparative) [% by weight]:

| | FFC1 | FFC2 | FFC3 |
|---|---|---|---|
| Methyl triethylene glycol borate ester | 61.6 | 61.6 | 61.7 |
| Methyl triethylene glycol | 26.3 | 25.7 | 26.4 |
| n-Butyl triethylene glycol | 10.05 | 9.65 | 10.05 |
| Castor oil ethoxylate [1]) | 0.2 | 0.2 | 0 |
| Diisopropanolamine | 1.0 | 1.0 | 1.0 |
| Octylamine ethoxylate (2 EO units) | 0.8 | 0.8 | 0.8 |
| Tolutriazol | 0.05 | 0.05 | 0.05 |
| Diethylene glycol | 0 | 1.0 | 0 |
| Friction coefficient values | 0.06 | 0.06 | 0.21 |

[1]) Castor oil reacted with 40 moles of ethylene oxide (i.e. on average 13.3 moles of ethylene oxide per mole of ricinoleic acid unit), ethoxylation solely occuring at the hydroxyl group located on the fatty acid side chain and keeping the glycerol triester function Example 2

Measurements at 100° C., weight 500 g, ball diameter of 1.3 mm, 50 Hz, way length 1000 μm Compositions of FFC2, FFC4 and FFC3 (comparative) [% by weight]:

| | FFC2 | FFC4 | FFC3 |
|---|---|---|---|
| Methyl triethylene glycol borate ester | 61.6 | 61.55 | 61.7 |
| Methyl triethylene glycol | 26.3 | 25.7 | 26.4 |
| n-Butyl triethylene glycol | 10.05 | 9.65 | 10.05 |
| Castor oil ethoxylate [1]) | 0.2 | 0.2 | 0 |
| Castor oil ethoxylate [2]) | 0 | 0.05 | 0 |
| Diisopropanolamine | 1.0 | 1.0 | 1.0 |
| Octylamine ethoxylate (2 EO units) | 0.8 | 0.8 | 0.8 |
| Tolutriazol | 0.05 | 0.05 | 0.05 |
| Diethylene glycol | 0 | 1.0 | 0 |
| Friction coefficient (start value $t_0$) | 0.23 | 0.21 | 0.25 |
| Time to damage ($t_{dam}$) [h:min] | 3:05 | 3:48 | 2:38 |

[1]) Castor oil reacted with 40 moles of ethylene oxide (i.e. on average 13.3 moles of ethylene oxide per mole of ricinoleic acid unit), ethoxylation solely occuring at the hydroxyl group located on the fatty acid side chain and keeping the glycerol triester function

[2]) Castor oil reacted with 20 moles of ethylene oxide, ethoxylation solely occuring at the hydroxyl group located on the fatty acid side chain and keeping the glycerol triester function $t_0$ is the friction coefficient at the beginning of the measurements.

Time to damage ($t_{dam}$) depicts the time from the beginning of the measurement to damage of the test plate.

The invention claimed is:

1. A brake fluid composition, comprising:

(A) from 15 to 90% by weight, based on a total weight of the composition, of one or more alkoxy glycol borate esters having formula (I)

$$[R^1—O—(CH_2CH_2—O)_n]_3B \quad (I)$$

wherein $R^1$ is a $C_1$- to $C_8$-alkyl radical or a mixture of such radicals and n has a value of from 2 to 6;

(B) from 5 to 99.99% by weight, based on the total weight of the composition, of one or more alkoxy glycol components having formula (II)

$$R^2—O—(CH_2CH_2—O)_m—H \quad (II)$$

wherein $R^2$ is a $C_1$- to $C_8$-alkyl radical or a mixture of such radicals and m has a value of from 2 to 6, and $R^2$ is different or identical to $R^1$ and/or m is different or identical to n;

(C) from 0.01 to 5% by weight, based on the total weight of the composition, of an alkoxylate of naturally occurring castor oil, wherein hydroxyl group located on fatty acid side chain of the alkoxylate is etherified by at least one oxyalkylene unit; and (D) from 0 to 10% by weight, based on the total weight of the composition, of an additive package comprising one or more additives with corrosion inhibition action, wherein the brake fluid composition does not comprise a defoamer.

2. The brake fluid composition according to claim 1, wherein component (C) is prepared by reaction of the castor oil with at least one alkylene oxide.

3. The brake fluid composition according to claim 1, wherein component (C) comprises from 2 to 200 ethylene oxide units.

4. The brake fluid composition according to claim 1, wherein component (A) comprises at least one alkoxy glycol borate of the formula (I) and n has a value of from 2 to 4.

5. The brake fluid composition according to claim 1, wherein component (A) comprises at least one alkoxy glycol borate of the formula (I), n has a value of 3, and $R^1$ is a methyl radical.

6. The brake fluid composition according to claim 1, wherein component (B) comprises a mixture of alkoxy glycols of the formula (II) comprising solely or predominantly species with m=3 and/or 4.

7. The brake fluid composition according to claim 1, comprising component (D), which is at least one alkylamine ethoxylate comprising at least one linear or branched $C_3$ to $C_{20}$ alkyl chain and 1 to 35 ethylene oxide units.

8. The brake fluid composition according to claim 1, exhibiting a dry equilibrium reflux boiling point (ERBP) of at least 260° C. and/or a wet equilibrium reflux boiling point (WERBP) of at least 180° C.

9. The brake fluid composition according to claim 1, exhibiting a low temperature kinematic viscosity of less than 750 centistokes, determined at a temperature of −40° C.

10. A method for actuating a braking mechanism, the method comprising:

transferring the brake fluid composition according to claim 1 to the braking mechanism.

11. A method for preparing a brake fluid, the method comprising:

introducing an alkoxylate of naturally occurring castor oil, which has hydroxyl group located on fatty acid side chain etherified by at least one oxyalkylene unit, as an additive with lubricating action into the brake fluid.

* * * * *